United States Patent [19]

Rogovein et al.

[11] Patent Number: 4,667,457

[45] Date of Patent: May 26, 1987

[54] HOPPER FOR ENVELOPES AND THE LIKE

[75] Inventors: Michael E. Rogovein; Stephen J. Benz, Jr.; Wayne H. Bloecker, all of Overland Park, Kans.

[73] Assignee: Tension Envelope Corporation, Kansas City, Mo.

[21] Appl. No.: 828,442

[22] Filed: Feb. 10, 1986

[51] Int. Cl.[4] ..... B65B 43/14

[52] U.S. Cl. ..... 53/569; 53/266 A; 221/211

[58] Field of Search ..... 53/266 A, 460, 569; 221/211, 268; 493/245, 122, 123

[56] References Cited

U.S. PATENT DOCUMENTS 1,738,119 12/1929 Sague ..... 53/266 A X
2,569,219 9/1951 Bamber et al. .
2,707,066 4/1955 Stegeman ..... 221/268 X
2,835,090 5/1958 DeMaine .
3,131,519 5/1964 Webster .
3,271,926 9/1966 England .
3,368,321 2/1968 Sather et al. .

*Primary Examiner*—James F. Coan
*Attorney, Agent, or Firm*—Litman Day & McMahon

[57] ABSTRACT

A hopper for an automatic envelope stuffer and the like includes first and second base rails each having a column extending upwardly therefrom. The columns are spaced further apart at their upper ends than at their lower ends. Endpieces are provided across the ends of the base rails and project upwardly to define a hopper space for receiving envelopes and the like. Support pins extend through the endpieces and project into the hopper space for supporting envelopes therein.

25 Claims, 9 Drawing Figures

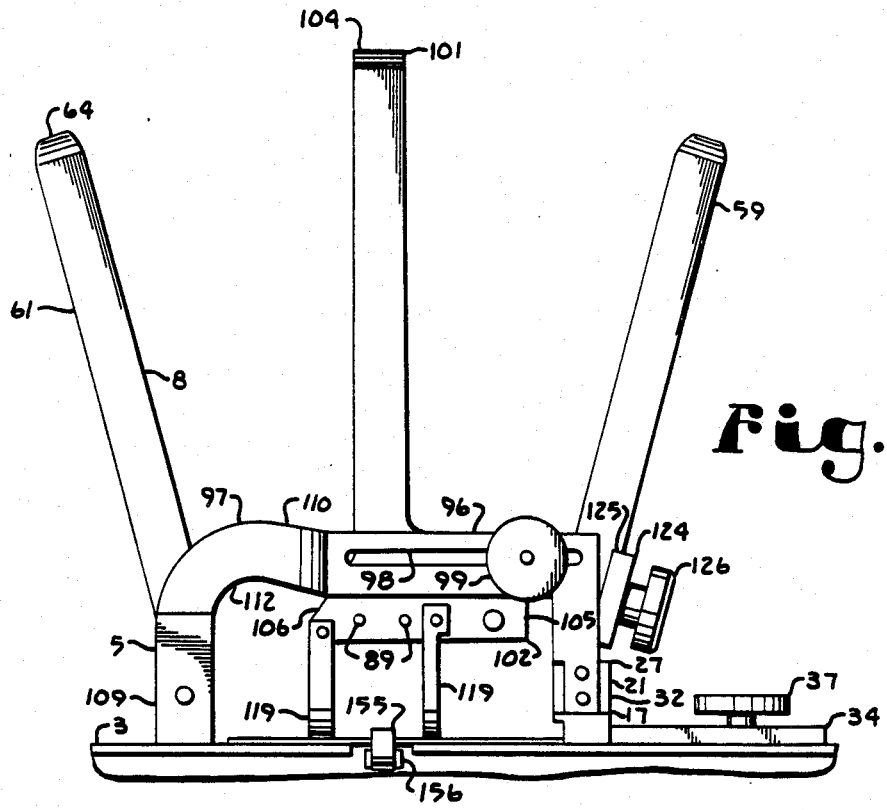
Fig. 6.
Fig. 7.
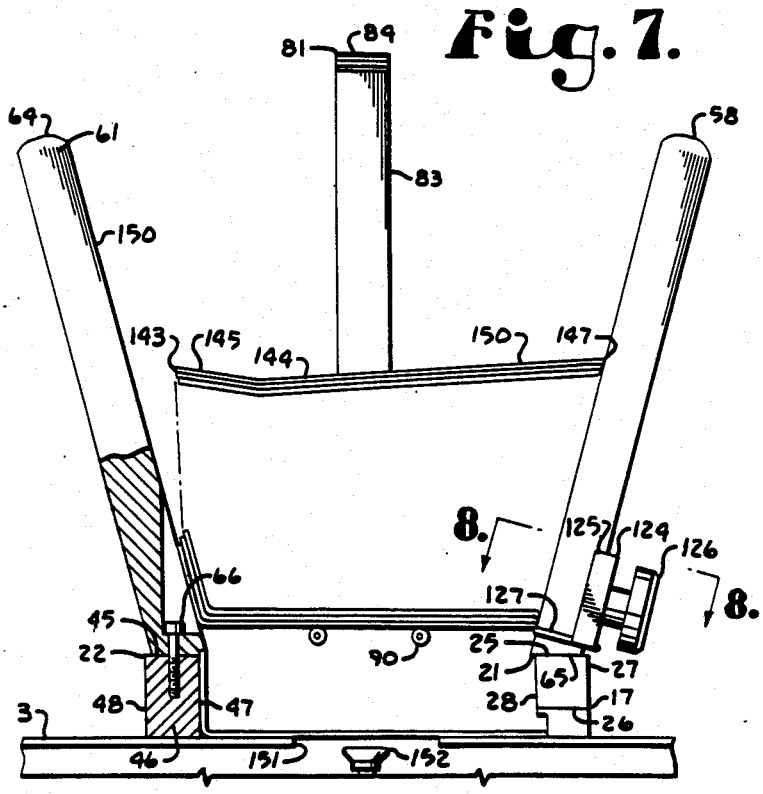
Fig. 8.
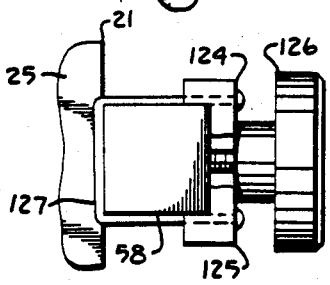
Fig. 9.
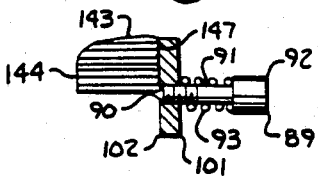

HOPPER FOR ENVELOPES AND THE LIKE

BACKGROUND OF THE INVENTION

1. Field of the Invention.

The present invention relates generally to automatic envelope stuffing equipment, and in particular to an improved hopper for converting such equipment for use with envelopes having latex seal adhesive.

2. Description of the Prior Art.

In businesses and institutions which routinely send out large quantities of mail, automatic envelope stuffing equipment is often utilized to facilitate such mass mailings. For example, in the banking industry it is common practice to mail each customer monthly statements of account. In addition to summarizing various account transactions for the preceding month, such statements are often accompanied by the cancelled checks received by the bank during the preceding month. Many banks employ automatic envelope stuffing equipment to insert statements and cancelled checks in envelopes for mailing to their customers.

Previous automatic envelope stuffing equipment was generally designed for use with remoistenable adhesive envelopes. For example, the Sather et al. U.S. Pat. No. 3,368,321 shows an inserter with a moistener assembly for moistening the gum or mucilage on the envelope flaps for sealing. In the Sather inserter, an envelope supply magazine station is provided wherein envelopes are stacked with their flaps in their closed positions. The remoistenable adhesive of such envelopes will not stick or adhere until moistened, hence the envelopes can be stored in such positions. The hoppers for remoistenable adhesive envelopes generally included a plurality of upright rods or plates which partially enclosed a space adapted to receive a stack of envelopes. For example, the plates in the Sather et al. inserter confine a stack of envelopes in the envelope supply magazine station.

Latex adhesive for envelopes has achieved substantial popularity because the adhesive surfaces to be joined are merely pressed together whereby the moistening step in the process and the attendant necessary equipment are obviated. Since such equipment tended to be somewhat messy and required a continuous water supply, the use of latex adhesive on the envelopes can make automatic envelope stuffing processes cleaner and simpler.

However, a disadvantage to the use of latex adhesive envelopes relates directly to their advantage, i.e. that their adhesive surfaces will stick together on contact. Thus, the seal flaps of latex adhesive envelopes generally must be in their open positions when such envelopes are stacked, as in automatic insertion equipment. This requirement has heretofore rendered many previous envelope stuffing machines unsuitable for use with latex adhesive envelopes, because their hoppers were designed to handle only envelopes with their seal flaps folded shut. Heretofore, there were relatively few, if any, automatic inserting machines adapted for interchangeable use with both remoistenable and latex adhesive envelopes or even with latex adhesive envelopes only, in spite of the advantages of such envelopes.

The present invention addresses this problem.

SUMMARY OF THE INVENTION

In the practice of the present invention, a hopper for envelopes and the like is provided which includes front and rear base rails. The base rails are mounted on the work surface of an automatic envelope stuffing machine. Three columns project upwardly and forwardly from the front base rail and two columns project upwardly and rearwardly from the back base rail. Thus, a hopper space defined between the columns converges downwardly. Endpieces are mounted at each end of the hopper and have pins projecting therethrough into the hopper space for supporting envelopes and the like. An envelope support assembly is slidably mounted on one of the front columns and includes a loop for supporting an envelope along its bottom margin.

OBJECTS OF THE INVENTION

The principal objects of the present invention are: to provide an improved hopper for automatic envelope insertion equipment; to provide such a hopper which is adapted for use with latex adhesive envelopes; to provide such a hopper which is adapted to receive a stack of such envelopes; to provide such a hopper which facilitates the reliable feeding of such envelopes; to provide such a hopper which includes mechanism for adjusting the support of such envelopes; to provide such a hopper which is readily adaptable to many existing automatic envelope inserting machines; to provide such a hopper which can be used with envelopes having both remoistenable and latex adhesive; to provide such a hopper which is relatively easily interchangeable with conventional envelope hoppers for remoistenable adhesive envelopes; and to provide such a hopper which is efficient in operation, capable of a long operating life, relatively easy to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is a transverse cross-section of the envelope stuffer taken generally along line 6—6 in FIG. 2 and showing the downstream end of the hopper.

FIG. 7 is a transverse cross-section of the envelope stuffer taken generally along line 7—7 in FIG. 2.

FIG. 8 is a fragmentary cross-section of the hopper taken generally along line 8—8 in FIG. 7 and showing an envelope support assembly.

FIG. 9 is an enlarged cross-section of the hopper particularly showing a support pin.

DETAILED DESCRIPTION OF THE PREFERRED EMBODIMENTS

Figure 1:
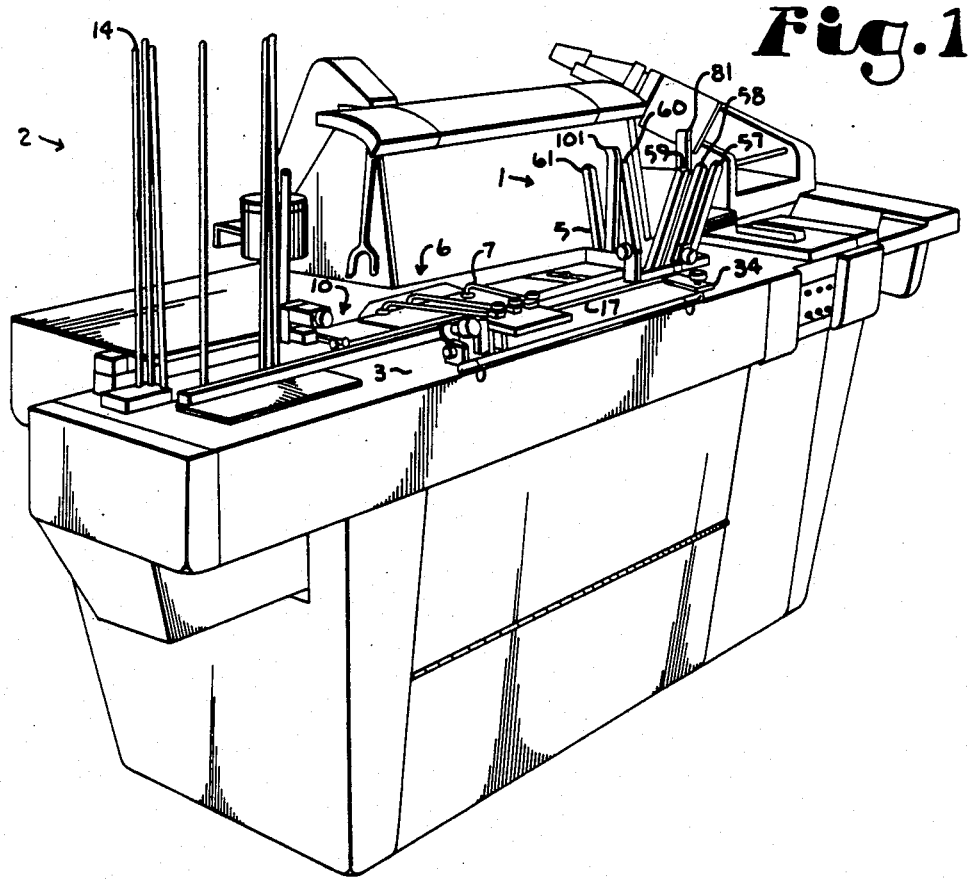
FIG. 1 is a perspective view of an automatic envelope stuffer with a hopper embodying the present invention.
Figure 3:
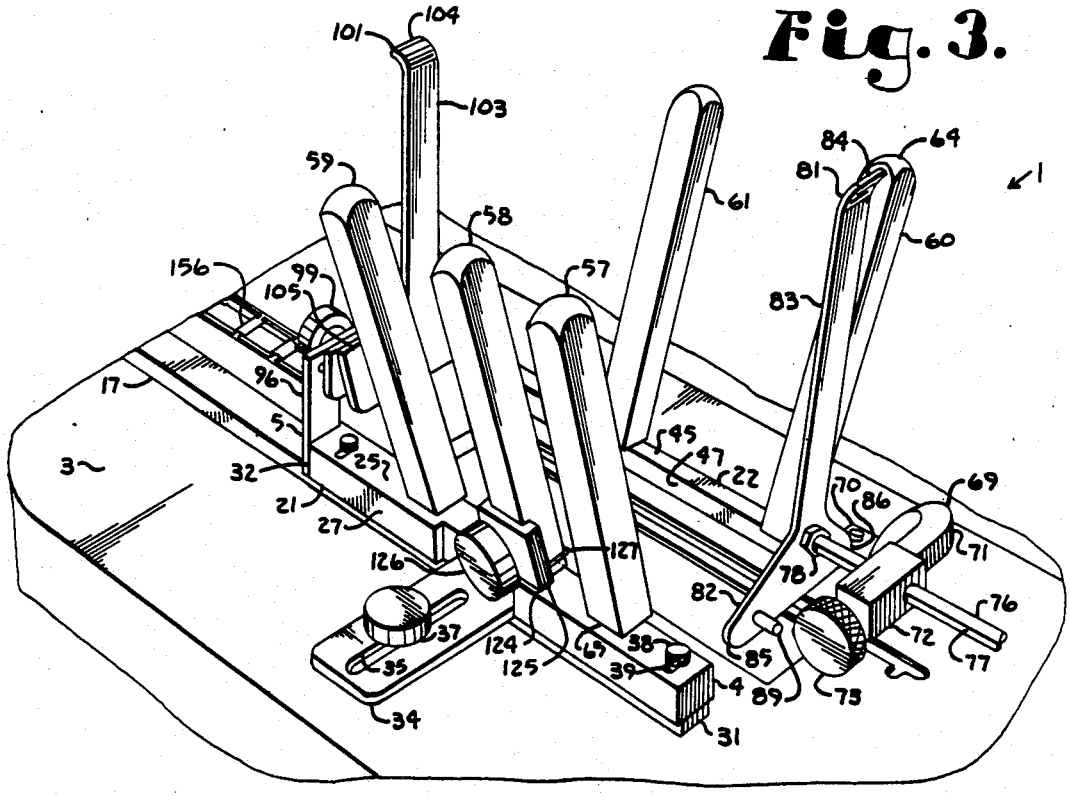
FIG. 3 is a perspective of the hopper.
Figure 2:
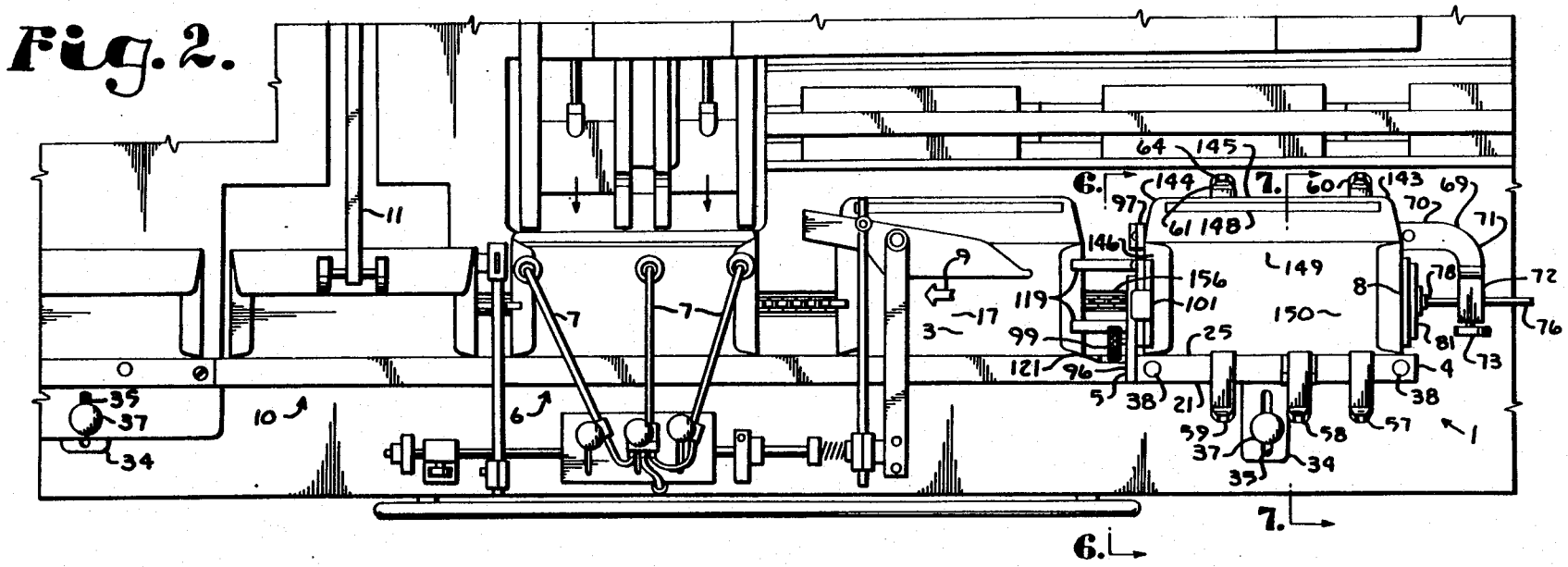
FIG. 2 is a fragmentary plan of the envelope stuffer.
Figure 5:
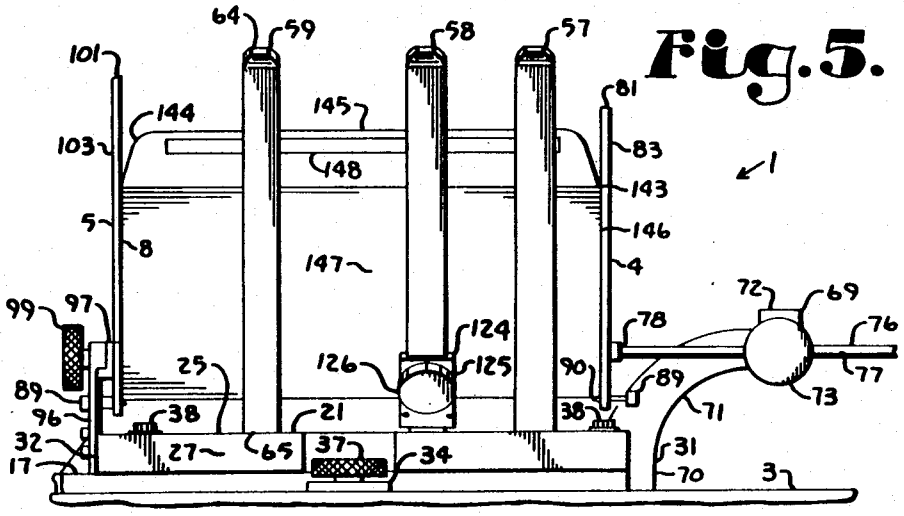
FIG. 5 is a front elevation of the hopper.
Figure 4:
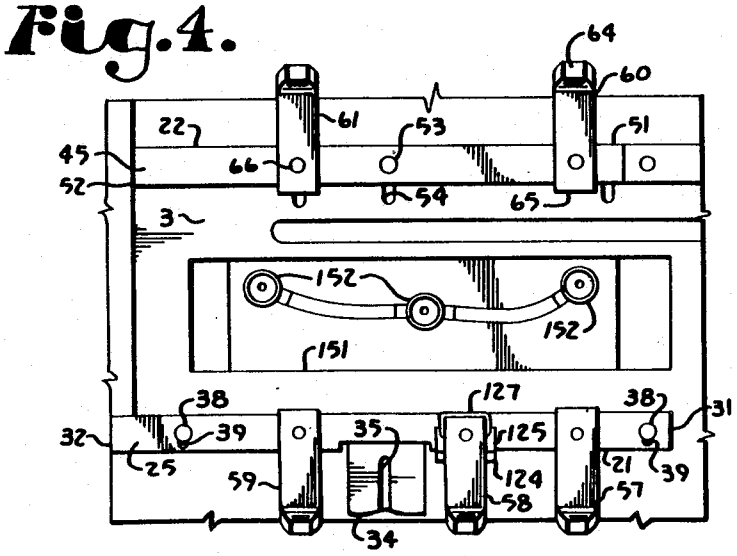
FIG. 4 is an enlarged plan of the hopper without envelopes.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an improved hopper embodying the present invention. The hopper 1 comprises part of an automatic envelope insertion machine or stuffer 2 and is mounted on a work surface 3 thereof. The hopper 1 includes upstream and downstream ends 4, 5 which are designated with respect to the direction that the envelopes and their contents move on the work surface 3, as shown by arrow 9. The hopper 1 partially encloses a hopper interior 8.

The envelope stuffer 2 is of a type which is well known in the industry. In addition to the hopper 1 and downstream thereof, the stuffer 2 includes an insertion station 6 whereat suction arms 7 raise the envelope back panel to open its mouth to receive the contents. Downstream of the insertion station 6 is a seal flap closing station 10 with a reciprocating roller assembly 11 adapted to secure the latex adhesive bond between the seal flap and the envelope back panel. Finally, a stuffed envelope hopper 14 is provided for the work product in a condition for receiving postage and then mailing.

An envelope guide bar 17 extends along the work surface 3 from the hopper 1 to the stuffed envelope hopper 14. Mounting tabs 34 with slots 35 receiving screws 37 are provided for mounting the guide bar 17 on the work surface 3. The mounting tab slots 35 allow the position of the guide bar 17 to be transversely adjusted.

The hopper 1 includes a front base rail 21 mounted on top of the envelope guide bar 17 and a rear base rail 22 mounted on the work surface 3 in parallel, spaced relation to the front base rail 21. The front base rail 21 includes top, bottom, front and back faces 25, 26, 27, 28 and upstream and downstream ends 31, 32 located at upstream and downstream hopper ends 4, 5 respectively. The front base rail 21 is secured to the guide bar 17 by bolts 38 extending therethrough adjacent either end 31, 32. The bolts 38 extend through transverse, slotted receivers 39 in the base rail ends 31, 32 so that the front-to-back positioning of the front base rail 21 can be adjusted.

The rear base rail 22 includes top, bottom, front and back faces 45, 46, 47, 48 and upstream and downstream ends 51, 52 located at upstream and downstream hopper ends 4, 5 respectively. The rear base rail 22 is mounted on the work surface 3 by countersunk screws 53 which extend through slotted receivers 54 in the work surface 3. The slotted receivers 54 allow the position of the rear base rail 22 to be adjusted transversely.

Upstream, middle and downstream front columns 57, 58, 59 are mounted on the front base rail top face 25 and extend upwardly and forwardly therefrom. Upstream and downstream rear columns 60, 61 are mounted on the rear base rail top face 45 and extend upwardly and rearwardly therefrom. The columns 57–61 have substantially square cross-sectional configurations, chamfered upper ends 64 and angled lower ends 65 which cause the columns 57–61 to slant to the front and rear of the hopper when mounted flush on the base rail top faces 25, 45. The columns 57–61 are mounted on the rails 21, 22 by Allen screws 66. Although columns 57–61 are shown, other structure such as plates, panels, etc. could be used in place thereof and are within the scope of the present invention.

An upstream end mounting bracket 69 includes a base 70 attached to the rear base rail upstream end 31, a curved neck 71 and a head 72 adapted to receive a set screw 73. An aperture extends longitudinally through the mounting bracket head 72 and receives a rod 76 with a flute 77 adapted to receive the set screw 73.

A downstream end 78 of the rod 76 mounts an upstream endpiece 81 comprising a generally transversely extending baseplate 82 and a flat bar 83 extending upwardly therefrom and terminating at an upper end 84 which curves in an upstream direction. The baseplate 82 includes front and back ends 85, 86 each mounting a respective envelope support pin 89 as shown in FIG. 9. Each support pin 89 includes a point 90 projecting inwardly into the hopper interior 8, a threaded shaft threadably received in the baseplate 82, a knurled head 92 and a helical compression spring 93 compressed between the baseplate 82 and the pin head 92. The distance that the pin points 90 extend from the baseplate 82 into the hopper interior 8 is adjustable by turning the pins 89.

Front and rear downstream end mounting brackets 96, 97 are mounted on the front and rear base rail downstream ends 32, 52 respectively and overlap each other as shown in FIG. 6. The front mounting bracket has a transversely extending slot 98 which receives a clamping screw 99. The slot 98 permits the amount of overlap between the mounting brackets 96, 97 to be adjusted when the base rails 21, 22 are moved transversely. A downstream endpiece 101 includes a baseplate 102 and an upright bar 103. The bar 103 includes an upper end 104 which curves outwardly from the hopper 1 in a downstream direction. The baseplate 102 threadably receives the clamping screw 99 whereby the mounting brackets 96, 97 and the baseplate 102 are clamped together.

The baseplate has front and rear ends 105, 106. Three transversely aligned envelope support pins 89 are threadably received in the baseplate 102 with their points 90 adjustably extending into the hopper interior 8.

The rear mounting bracket 97 includes a proximate section extending upwardly and rearwardly from the rear base rail downstream end 52 in a direction substantially parallel to the rear columns 60, 61 and a distal section 110 extending forwardly and downwardly from the proximate section 109. A seal flap passage 112 is formed between the sections 109, 110.

A seal flap deflector 115 is mounted on the rear mounting bracket proximate section 109 and extends upstream therefrom. The deflector 115 has a sloping front surface 116 which is substantially parallel to the mounting bracket proximate section 109 where they intersect. The front surface 116 curves rearwardly in an upstream direction from the bracket proximate section 109.

A pair of envelope guide tines 119 curve downwardly and in a downstream direction from the endpiece baseplate 102. One of the guide tines 119 is mounted behind the rearmost support pin 89 on the baseplate 102 and the other guide tine 119 is mounted between the frontmost and the center support pins 89. Immediately downstream of the front base rail downstream end 32, a guide tine 121 curves upwardly in an upstream direction from the top surface of the envelope guide bar 17.

An intermediate envelope support assembly 124 includes a plate 125 slidably engaging the front face of the front middle column 58, a set screw 126 and a wire loop 127 which extends rearwardly from the plate 125 and slidably receives the front middle shaft 58.

In operation on the automatic envelope stuffer 2, the hopper 1 receives a stack 143 of envelopes 144 having rearwardly-extending, open seal flaps 145, opposite side margins 146 and bottom margins 147. The stack 143 is placed in the hopper 1 with the latex adhesive strips 148 on the seal flaps 145 facing up and the envelope bottom margins 147 against the front columns 57, 58, 59. The envelopes 144 also include latex adhesive strips 149 on their back panels 150. When the adhesive strips 148, 149 surfaces are pressed together, they adhere to each other. Therefore, the seal flaps 145 must be kept open until the envelopes 144 receive their contents and are ready for sealing.

With the hopper 1 properly adjusted, the upper ends 64 of the columns 57–61 are spaced farther apart than the overall heights of the envelopes 144 with their seal flaps 145 extended. The slope of the columns 57–61 provides sufficient width for the envelopes in the upper part of the stack 143. Furthermore, the distance between the front columns 57, 58, 59 and the rear columns 60, 61 at their respective lower ends 65 is carefully calibrated to correspond to the height that the envelope 144 will have when their seal flaps 145 are folded shut. Thus, the lowermost envelope 144 is always positioned in substantially the same location within the hopper interior 8. The placement of the lowermost envelope 144 on the work surface 3 can therefore be relatively precisely controlled.

When the stack 143 is placed in the hopper 1 by an operator, downward pressure on the top envelope 144 causes all of the envelopes 144 to fold somewhat at their seal flaps 145, with the lowermost envelopes folding the most because of the downward convergence of the front columns 57, 58, 59 and the rear columns 60, 61. As each envelope 144 progresses downwardly, its respective seal flap 145 becomes folded more and more sharply with respect to the body of the envelope 144 until it reaches the lowermost position whereat the seal flap 145 forms an obtuse angle of slightly greater than 90° with respect to the remainder of the envelope 144.

The envelope stack 143 is positioned over an envelope hopper opening 151 in the work surface 3. Mounted directly below the opening 151 are three suction cups 152. At appropriate times in the envelope stuffing cycle, the suction cups 152 raise and extract the lowermost envelope 144.

With the envelope stack 143 in the hopper interior 8, the lowermost envelope 144 is supported along its side margins 146 by the points 90 of the support pins 89 and along its bottom margin 147 by the loop 127. Its seal flap 145 is placed against the rear columns 60, 61. Upon actuation of the suction cups 152, the lowermost envelope 144 is pulled downwardly. By adjusting the distance that the support pins 90 protrude from the endpiece baseplates 82, 102 and the position of the envelope support assembly 124, the force required to extract the lowermost envelope 144 can be varied.

When the lowermost envelope 144 is pulled downwardly by the suction cups 152 onto the work surface 3, it is grasped by a clasp 155 mounted on an endless chain 156 positioned below the work surface 3. The chain pulls the envelope 144 through the various stations 6, 10 and 14 whereat it receives inserts, is folded and sealed, and stacked. As the envelope 144 is pulled downstream out from under the hopper 1, the seal flap deflector 115 guides the seal flap 145 through the seal flap passage 112.

The hopper 1 is also adapted for use with envelopes having remoistentable adhesive. Alternatively, it can easily be removed from the envelope stuffer 2 and replaced by a different hopper.

It is to be understood that while certain forms of the present invention have been illustrated and described herein, it is not to be limited to the specific forms or arrangement of parts described and shown.

What is claimed and desired to be secured by Letters Patent is as follows:

1. In combination with an automatic envelope stuffing machine having a work surface along which envelopes with seal flaps and bottom margins move from upstream to downstream, the improvement of an envelope hopper, which comprises:

(a) base means;

(b) a first column mounted on and extending upwardly from said base means and including a top and a bottom;

(c) a second column mounted on and extending upwardly from said base means in spaced relation from said first column and including a top and a bottom;

(d) said column bottoms being more closely spaced than the total heights of said envelopes with their seal flaps extended and said column tops being spaced apart a distance greater than the heights of said envelopes with their seal flaps extended whereby a downwardly converging hopper interior is defined between said columns, said hopper interior converging downwardly continuously, to a position of the lowermost envelope in said hopper;

(e) said envelope bottom margins slidably engaging said first column and said envelope seal flaps slidably engaging said second column whereby said envelope seal flaps are folded with respect to said envelopes as they advance downwardly in said hopper interior; and (f) support means adapted to support the lowermost of said envelopes in a predetermined position in said hopper interior.

2. The hopper according to claim 1 wherein:

(a) said base means includes first and second base rails positioned in spaced relation; and (b) said first and second columns extend upwardly from said first and second base rails respectively.

3. The hopper according to claim 2, which includes:

(a) a plurality of columns mounted on and extending upwardly from said first base rail; and (b) a plurality of columns mounted on and extending upwardly from said second base rail.

4. The hopper according to claim 1, which includes:

(a) said hopper having first and second ends; and (b) first and second endpieces positioned at said first and second hopper ends respectively with said hopper interior being located between said endpieces.

5. The hopper according to claim 4 wherein:

(a) said support means comprises a plurality of support pins each extending through a respective endpiece and into said hopper interior for supporting envelopes and the like therein.

6. The hopper according to claim 1 said support means includes:

(a) a plate slidably engaging one of said columns;

(b) a loop slidably receiving said one column; and (c) means for securing said plate and said loop to said one column.

7. The envelope hopper according to claim 1 wherein:

(a) said support means is vertically slidably mounted on one of said columns.

8. In combination with an automatic envelope stuffing machine having a work surface along which envelopes move from upstream to downstream, the improvement of an envelope hopper, which comprises:

(a) a front base rail including a top face and upstream and downstream ends;

(b) a back base rail including a top face and upstream and downstream ends;

(c) means for mounting said front and back base rails on said work surface, said means selectively permitting movement of said base rails transverse to said work surface whereby the positions of said base rails on said work surface may be transversely adjusted;

(d) upstream, intermediate and downstream columns mounted on said front baseplate top face and projecting upwardly and forwardly therefrom;

(e) upstream and downstream columns mounted on said rear base rail top face and projecting upwardly and rearwardly therefrom;

(f) a mounting arm attached to one of said base rail upstream ends and including a receiver aligned longitudinally with said hopper and a set screw selectively threadably extending into said receiver;

(g) a rod slidably extending through said mounting bracket receiver and including a downstream end;

(h) an upstream endpiece including a baseplate extending transversely across an upstream end of said hopper and a bar extending upwardly from said baseplate, said baseplate being mounted on said rod downstream end;

(i) a front downstream mounting arm attached to said front base rail downstream end and extending rearwardly therefrom;

(j) a rear downstream mounting arm including:

(1) a proximate section attached to said rear base rail downstream end;

(2) a distal section extending forwardly and downwardly from said proximate section; and (3) said proximate and distal sections defining a seal flap passage with said work surface;

(k) a downstream endpiece including a baseplate connected to said downstream mounting arms and a bar extending upwardly from said baseplate;

(l) a plurality of support pins each threadably received in a respective endpiece baseplate and projecting therefrom into an interior of said hopper;

(m) a seal flap deflector mounted on said rear downstream mounting arm and having a front surface extending rearwardly and in an upstream direction from said rear downstream mounting arm proximate section; and (n) an envelope support assembly including a plate slidably engaging the front of said front intermediate column and threadably receiving a set screw adapted for engaging said front intermediate column, said envelope support assembly having a rearwardly-extending loop slidably receiving said front intermediate column.

9. A hopper for envelopes and the like, which comprises:

(a) a first base rail;

(b) a second base rail positioned in spaced relation from said first base rail;

(c) a first column having a top and a bottom and extending upwardly from said first base rail;

(d) a second column having a top and a bottom and extending upwardly from said second base rail;

(e) a hopper interior formed between said columns;

(f) said columns being positioned closer together at their respective bottoms than at their tops;

(g) a plate slidably engaging one of said columns;

(h) a loop slidably receiving said one column; and (i) means for securing said plate and said loop to said one column.

10. The hopper according to claim 9, which includes:

(a) first and second opposite ends; and (b) first and second endpieces positioned at said first and second hopper ends respectively with said hopper interior being located between said endpieces.

11. The hopper according to claim 10, which includes:

(a) a plurality of support pins each extending through a respective endpiece and into said hopper interior for supporting envelopes and the like therein.

12. The hopper according to claim 11 wherein:

(a) a pair of said support pins extend through each said endpiece in horizontally spaced relation.

13. The hopper according to claim 11 wherein each said endpiece includes:

(a) an endpiece baseplate mounting a respective support pin; and (b) an endpiece bar extending upwardly from said endpiece baseplate.

14. The hopper according to claim 10 wherein:

(a) at least one of said endpieces is longitudinally adjustable with respect to said hopper.

15. The hopper according to claim 11 wherein each said support pin is threadably received in a respective endpiece whereby the projection of said support pin into said hopper interior is adjustable.

16. The hopper according to claim 10, which includes:

(a) said base rails having opposite ends;

(b) a first endpiece mounting bracket mounted on an end of said first base rail;

(c) a second endpiece mounting bracket including a proximate section mounted on a corresponding end of said second base rail and a distal section; and (d) one of said endpieces being mounted on said endpiece mounting brackets at a respective hopper end.

17. The hopper according to claim 10, which includes:

(a) each said base rail having first and second ends; and (b) a first endpiece mounting bracket mounted on one of said base rail first ends and mounting said first endpiece at said hopper first end.

18. The hopper according to claim 16, which includes:

(a) said hopper being mounted on a work surface; and (b) said second mounting bracket sections forming an envelope seal flap passage with said work surface.

19. The hopper according to claim 18, which includes:

(a) a seal flap deflector mounted on said second mounting bracket, said deflector having a surface which curves from said mounting bracket proximate section towards said second base rail.

20. A hopper for envelopes and the like, which comprises:

(a) base means;

(b) first and second column means mounted on and extending upwardly from said base means in spaced relation and defining a hopper interior therebetween, said hopper interior being wider at the top and at the bottom;

(c) a plate slidably engaging one of said column means;

(d) a loop slidably receiving said one column means; and (e) means for securing said plate and said loop to said one column means.

21. The hopper according to claim 20, which includes:

(a) a plurality of said columns extending upwardly from said base means.

22. The hopper according to claim 20 wherein:

(a) said column means are slanted substantially the same amount in opposite directions whereby said hopper interior converges downwardly.

23. A hopper for envelopes and the like, which comprises:

(a) a first base rail;

(b) a second base rail positioned in spaced relation from said first base rail;

(c) a first column having a top and a bottom and extending upwardly from said base rail;

(d) a second column having a top and a bottom and extending upwardly from said second base rail;

(e) a hopper interior formed between said columns;

(f) said columns being positioned closer together at their respective bottoms than at their tops;

(g) first and second opposite ends;

(h) first and second endpieces positioned at said first and second hopper ends respectively with said hopper interior being located between said endpieces, each said endpiece including:

(1) an endpiece baseplate mounting a respective support pin; and (2) an endpiece bar extending upwardly from said endpiece baseplate;

(i) a plurality of support pins each extending through a respective endpiece into said hopper interior for supporting envelopes and the like therein.

24. The hopper according to claim 23, which includes:

(a) a plate slidably engaging one of said columns;

(b) a loop slidably receiving said one column; and (c) means for securing said plate and said loop to said one column.

25. A hopper for envelopes and the like, which comprises:

(a) a first base rail;

(b) a second base rail positioned in spaced relation from said first base rail;

(c) a first column having a top and a bottom and extending upwardly from said first base rail;

(d) a second column having a top and a bottom and extending upwardly from said second base rail;

(e) a hopper interior formed between said columns;

(f) said columns being positioned closer together at their respective bottoms than at their tops;

(g) first and second opposite ends;

(h) first and second endpieces positioned at said first and second hopper ends respectively with said hopper interior being located between said endpieces; and (i) a plurality of support pins each threadably received in a respective endpiece and extending into said hopper interior for supporting envelopes and the like therein whereby the projection of each said support pin into said hopper interior is adjustable.

* * * * *